US006240566B1

(12) United States Patent
Scantlin

(10) Patent No.: US 6,240,566 B1
(45) Date of Patent: Jun. 5, 2001

(54) OPEN-BACK HAT

(76) Inventor: Natalie B. Scantlin, 327 N. Shore Dr., Kansas City, MO (US) 64151

( * ) Notice: Subject to any disclaimer, the term of this patent is extended or adjusted under 35 U.S.C. 154(b) by 0 days.

(21) Appl. No.: 09/577,089

(22) Filed: May 24, 2000

(51) Int. Cl.[7] ..... A42B 1/00
(52) U.S. Cl. ..... 2/171; 2/209.13
(58) Field of Search ..... 2/195.1, 171, 171.1, 2/182.8, 174, 209.13, 209.7, 171.4, 171.8, 181, 181.2, 209.11, 209.12, 209.3, 185.5

(56) References Cited

U.S. PATENT DOCUMENTS

D. 173,620 * 12/1954 Krieger et al. ..... 2/171
1,614,231 * 1/1927 Cosgrove ..... 2/171
2,864,383 * 12/1958 Jacks et al. ..... 2/171
4,131,953 * 1/1979 Kimotsuki ..... 2/171.1
4,630,317 * 12/1986 Brown et al. ..... 2/12
4,872,218 * 10/1989 Holt ..... 2/171.5
5,170,509 * 12/1992 Leopold ..... 2/195.1
5,239,705 * 8/1993 Leopold ..... 2/209.13
5,321,854 * 6/1994 Kronenberger ..... 2/209.7
5,509,145 * 4/1996 Stevenson et al. ..... 2/195.1
5,799,334 * 9/1998 Griffith et al. ..... 2/195.1
5,875,488 * 3/1999 Milani ..... 2/12

* cited by examiner

*Primary Examiner*—Gloria M. Hale
(74) *Attorney, Agent, or Firm*—Hovey, Williams, Timmons & Collins

(57) ABSTRACT

An open-back hat (10) is provided which includes an adjustable sweatband (12), a forwardly extending bill (16), and a crown extending upwardly from the sweatband and bill in order to cover the forehead and sides of a wearer's head, while leaving a large rear open area (20). The area (20) allows pull-through of long hair and/or special hairstyles. In this manner, women or men with long hair may wear a baseball-type hat without fear of hairstyle damage.

12 Claims, 1 Drawing Sheet

OPEN-BACK HAT

BACKGROUND OF THE INVENTION

1. Field of the Invention

The present invention is broadly concerned with improved hat designs, particularly an improved baseball-type hat which is configured to allow a wearer to have virtually any type of hairstyle. More particularly, the invention is concerned with such hats which are characterized by relatively large rear openings allowing long hairstyles such as pony tails or the like to be readily pulled through the rear openings. In this fashion, the hats give maximum flexibility of use for a wearer.

2. Description of the Prior Art

Until recent years, baseball-type hats were worn primarily by young men. However, in more recent times women have begun to wear such hats in increasing numbers. As is well known, typical baseball hats include a fabric crown which covers substantially all the wearer's head. In order to provide a universal fit hat, it is common to provide an adjustable sweatband and a relatively small, arcuate adjustment opening above the rearmost portion of the sweatband. The sweatband has an interlocking projection and opening structure allowing the hat size to be adjusted. Alternatively, the hat may be pre-sized or adjustably sized through a number of ways commonly known in the art including through straps having hook and loop type fasteners, belt buckle-type straps, and friction plate straps.

Many people have taken advantage of the small adjustment opening provided with baseball-type hats, by pulling their longer hair through the adjustment opening.

While this is acceptable for certain types of hairstyles such as low pony tails, there is insufficient open area in typical hats to accommodate very long hairstyles, high pony tails or "updos." In these situations, the users had to either forgo wearing a hat altogether, or risk damage to the hairstyle.

SUMMARY OF THE INVENTION

The present invention overcomes the problems outlined above and provides an improved open-back hat which is especially designed to provide a significantly larger rear open area allowing wearing of the hat by men and women with elaborate hairstyles. Broadly speaking, the hats of the invention include a sweatband configured to encircle the head of a wearer, with the sweatband having a forward arcuate portion extending forwardly from the approximate ear region of the wearer and around the wearer's forehead, and a rearward arcuate portion extending from about the ear portion and around the back of the wearer's head. A crown is operatively coupled with the sweatband and extends upwardly from the forward portion thereof to cover the wearer's forehead and the sides of the wearer's head to approximately the ear region. The crown presents a rear margin extending from the top of the wearer's head downwardly to the sweatband so as to define an open area between the crown rear margin and the sweatband.

In preferred forms, the sweatband is adjustable to accommodate different head sizes, and the crown is designed with a reinforcing band at the rear margin thereof. Preferably, from about 30–70% of the plan surface area defined by the sweatband is open. This provides a rear opening of sufficient size to accommodate virtually all popular hairstyles.

DETAILED DESCRIPTION OF THE PREFERRED EMBODIMENT

Figure 1:
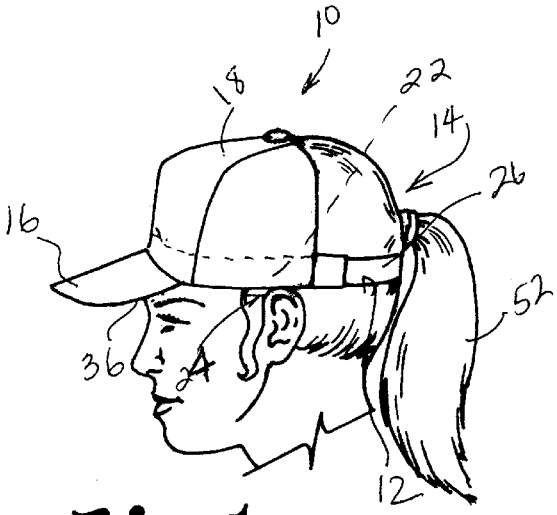
FIG. 1 is a side elevational view of an open-back hat in accordance with the invention, shown on a wearer's head and with the wearer's hair extending through the large rear open area of the hat.
Figure 2:
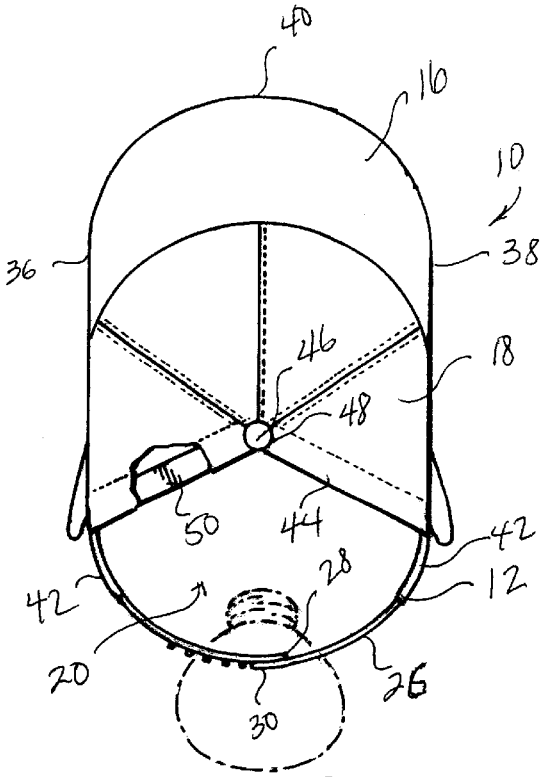
FIG. 2 is a top view of the hat illustrated in FIG. 1, with a portion of the wearer's hairdo extending through the open area illustrated in phantom, and with a portion of the crown rear margin broken away to depict the underlying rear reinforcing strap.
Figure 3:
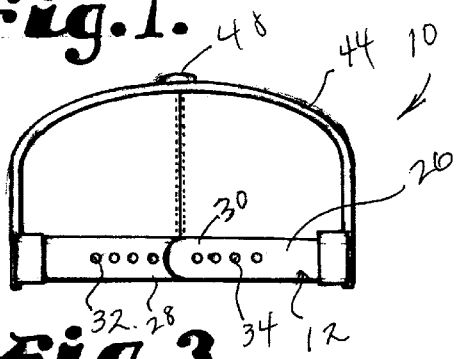
FIG. 3 is a rear elevational view of the cap depicted in FIGS. 1 and 2.

Turning now to the drawing, and particularly FIGS. 1–3, an open-back hat 10 in accordance with the invention is depicted. The hat 10 includes a sweatband 12 which encircles the head of a wearer 14, as well as a forwardly projecting bill 16 and a crown 18. As best seen in FIG. 2, the rear section of the crown is open, thereby defining a large open area 20 between the trailing edge of the crown and the sweatband 12.

In more detail, the preferred sweatband 12 includes a forward arcuate portion 22 which extends forwardly from a position 24 which is approximately adjacent the wearer's ears and around the wearer's forehead. Furthermore, the sweatband has a similar rearward portion 26 which extends from the position 24 rearwardly and around the back of the wearer's head. In preferred forms, a portion of the sweatband is formed of a continuous strip of synthetic resin material, and has rear, mating free ends 28, 30. As best seen in FIG. 3, the end 28 has a series of spaced apart projections 32 formed thereon, whereas the adjacent free end 30 has correspondingly sized openings 34 adapted to receive the projections 32. In this way, the sweatband is adjustable to accommodate different head sizes. It is understood that other types of adjustably sized hats are within the scope of invention as are hats which have a pre-set size.

The bill 16 is entirely conventional in baseball-type caps or hats, and presents opposed, forwardly extending side margins 36, 38 and a front margin 40. Of course, the precise shape and/or length of the bill 16 is extremely variable.

The crown 18 is secured to the sweatband 12 via tubular couplers 42 and by stitching or the like as in conventional hats. The crown 18 extends upwardly from the position 24 adjacent the wearer's ears and also from the arcuate forward portion 22 of the sweatband, so as to cover the wearer's forehead and the sides of the wearer's head back to the position 24. The crown 18 also presents a rear margin 44 which extends upwardly from position 24 to a point 46 at the top of the wearer's head, where a conventional button 48 is typically affixed to the crown. In order to provide additional support, a reinforcing band 50 extends from the opposed couplers 42 along the length of the margin 44. The band 50 is preferably sewn into the fabric making up the crown 18 to provide the best reinforcing support. However, it is understood that inclusion of this band 50 is an accessory and not a necessity for purposes of the present invention.

The open area 20 is thus defined between the rear margin 44 and the top of portion 26 of the sweatband 12. As best viewed in FIG. 2, from about 30–70% of the plan surface area between the margin 44 and sweatband portion 26 is open. More preferably, from about 40–60% of this plan surface area is open, and most preferably about 50% is open. In this way, a hairstyle such as the ponytail 52 shown in FIG. 1 can readily be pulled through the area 20.

Figure 4:
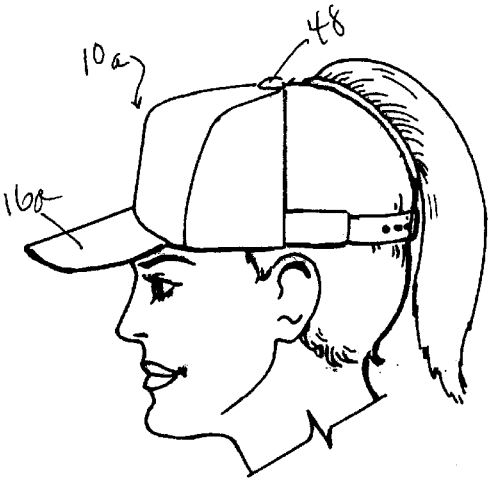
FIG. 4 is a side elevational view similar to FIG. 1, but illustrating the hat on a wearer having a different hairstyle.
Figure 5:
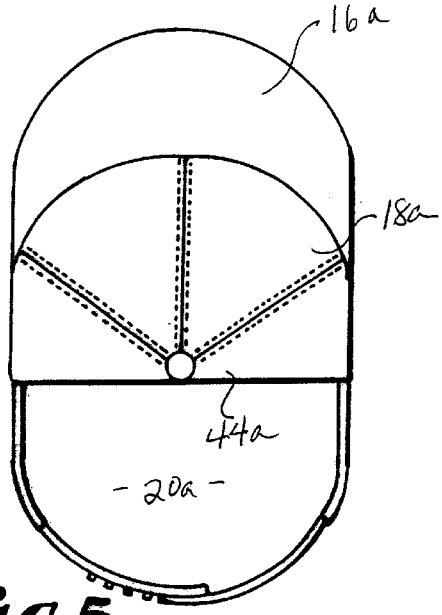
FIG. 5 is a plan view similar to that of FIG. 2 but showing a modified embodiment with a larger view open area.

A second embodiment is illustrated in FIGS. 4–5. In this case, the hat 10*a* is identical with the previously described hat 10 except that the rear margin 44*a* of the crown 18*a* is substantially rectilinear in plan configuration and thereby presents a greater open area 20*a*. Thus accommodating larger and higher hairstyles 52*a* such as those shown in FIG. 4.

To display a hairstyle while simultaneously wearing a hat, a hat 10 in accordance with the present invention is donned on the head of a wearer 14. Next, the hairstyle is positioned such that it extends through the open rear area 20, 20*a*, thus allowing the wearer 14 to display their hairstyle while still enjoying the benefits of wearing a hat. Alternatively, a hairstyle may be accommodated while the hat 10 is being positioned and sized for the wearer 14. In this manner, free ends 28, 30 of sweatband 12 would be uncoupled while the hairstyle was positioned to project through open area 20, 20*a*. Once the hairstyle was in place, the free ends 28, 30 of the sweatband 12 would be coupled together and the hat would be sized.

The hats of the invention provide a number of advantages. First and foremost, long hair of virtually any style can be pulled through the large rear open area 20 of the hat, completely eliminating the restrictions imposed by conventional hats and the relatively small size adjustments provided therein. Both long and short hairstyles are readily accommodated, and virtually all styles including deadlocks, curly hair styles, high and low pony tails, pigtails and "updos." At the same time, the hairstyling is not ruined or damaged as can occur with conventional hats and the hat operates to keep sweat off of a wearer's forehead and hair off the back of one's neck. Thus, the present invention provides all of the benefits of regular ballcaps and permits a wearer to achieve the "ballcap look" while simultaneously displaying the hairstyle without damage to the hairstyle or giving the wearer hat-head.

I claim:

1. A hat comprising:

a sweatband configured to encircle the head of a wearer and having a forward arcuate portion extending forwardly from a position approximately adjacent the wearer's ears and around the wearer's forehead, and a rearward arcuate portion extending rearwardly from said position and around the back of the wearer's head;

a bill extending forwardly from said sweatband and presenting opposed side margins; and a crown extending upwardly from said forward arcuate portion of said sweatband to cover the forehead and sides of the wearer's head to said position, said crown presenting a rear margin extending from the top of the wearer's head downwardly to said sweatband, there being an open area between said crown rear margin and said rearward arcuate portion of said sweatband for passage of the wearer's hair through said open area, and having from about 30–70% of the plan surface area defined by said sweatband being opened so as to form said open area.

2. The hat of claim 1, including a reinforcing band extending along the length of said crown rear margin, the ends of said reinforcing band secured to said sweatband.

3. The hat of claim 1, said crown formed of continuous, substantially imperforate fabric.

4. The hat of claim 1, said sweatband being adjustable to accommodate different head sizes.

5. The hat of claim 1, from about 40–60% of said plan surface area being open.

6. A method of displaying a hairstyle while wearing a ballcap comprising the steps of:

1) donning the hat of claim 1; and 2) positioning said hairstyle in a projecting manner through the open area.

7. The method of claim 6, further including the step of sizing said hat.

8. A hat comprising:

a sweatband configured to encircle the head of a wearer and having a forward arcuate portion extending forwardly from a position approximately adjacent the wearer's ears and around the wearer's forehead, and a rearward arcuate portion extending rearwardly from said position and around the back of the wearer's head;

a bill extending forwardly from said sweatband and presenting opposed side margins;

a crown extending upwardly from said forward arcuate portion of said sweatband to cover the forehead and sides of the wearer's head to said position, said crown presenting a rear margin extending from the top of the wearer's head downwardly to said sweatband, there being an open area between said crown rear margin and said rearward arcuate portion of said sweatband for passage of the wearer's hair through said open area; and said hat including a reinforcing band extending along the length of said crown rear margin, the ends of said reinforcing band secured to said sweatband.

9. The hat of claim 8, said crown formed of continuous, substantially imperforate fabric.

10. The hat of claim 8, said sweatband being adjustable to accommodate different head sizes.

11. The hat of claim 8, from about 30–70% of the plan surface area defined by said sweatband being opened so as to form said open area.

12. The hat of claim 11, from about 40–60% of said plan surface area being open.

* * * * *